United States Patent [19]

Scifoni

[11] Patent Number: 4,499,267

[45] Date of Patent: Feb. 12, 1985

[54] ADDITIVE FOR OTTO CYCLE ENGINES AND FUEL MIXTURE SO OBTAINED

[76] Inventor: Mario Scifoni, Via della Divina Provvidenza 26, 00166 Roma, Italy

[21] Appl. No.: 544,170

[22] Filed: Oct. 21, 1983

[30] Foreign Application Priority Data

Aug. 17, 1983 [IT] Italy ..... 48858 A/83

[51] Int. Cl.[3] ..... C10L 1/32

[52] U.S. Cl. ..... 44/51; 44/53; 123/1 A; 252/398

[58] Field of Search ..... 44/53, 51; 424/195; 252/398; 123/1 A

[56] References Cited

U.S. PATENT DOCUMENTS

| | | | |
|---|---|---|---|
| 663,370 | 12/1900 | Taylor et al. | 44/66 |
| 1,587,899 | 6/1926 | Carroll et al. | 44/56 |
| 2,117,610 | 5/1938 | Jean | 44/9 |
| 2,214,749 | 9/1940 | McCurry | 44/9 |
| 2,345,579 | 4/1944 | Buxton | 44/66 |
| 2,807,527 | 9/1957 | Brown et al. | 44/61 |
| 2,897,070 | 7/1959 | Newman et al. | 44/63 |
| 3,818,876 | 6/1974 | Voogd | 123/25 R |
| 3,849,323 | 11/1974 | Hollinshead | 252/56 R |
| 4,300,912 | 11/1981 | Townsend | 44/56 |
| 4,359,324 | 11/1982 | Elsea, Jr. et al. | 44/53 |
| 4,425,136 | 1/1984 | Pearson et al. | 44/51 |

*Primary Examiner*—Y. Harris-Smith

*Attorney, Agent, or Firm*—Beveridge, DeGrandi & Kline

[57] ABSTRACT

The additive for Otto cycle engines according to the present invention consists of a mixture of water, ethanol, methanol and butanol to which is added a determined quantity of a liquid obtained by pressing prickly pear leaves. Added in a small percentage to the fuel, gasoline, LP or methane, this additive prevents the oxidation associated with the use of water and/or alcohols in Otto cycle engines, lowers fuel consumption and allows the use of low octane fuel.

19 Claims, No Drawings

ADDITIVE FOR OTTO CYCLE ENGINES AND FUEL MIXTURE SO OBTAINED

The present invention refers to an additive for Otto cycle engines and to the fuel mixture so obtained. More precisely, it refers to an additive containing a mixture of water and low molecular weight alcohols to which has been added the liquid obtained from pressing prickly pear leaves as the essential element. Considerations such as elevated cost and insufficient availability of suitable hydrocarbons, whether synthesized or derived from petroleum, led to the necessity to reduce the consumption of such hydrocarbons, or rather to increase the power delivered by a given engine or to avoid the use of polluting additives such as tetraethyl lead. Therefore there have been many attempts to add water and/or alcohols to the fuel used for Otto cycle engines. In effect, these new fuels have been shown to be advantageous in many cases. However they have a disadvantage that has discouraged their large scale use: the water or alcohols (generally low molecular weight) added to the fuel leads after continuous use to the removal of the already scarce lubrification along the cylinder walls in the section corresponding to the piston stroke starting from the first upper elastic strap of the piston itself. Said removal of lubrification leads to oxidation, in particular during long stops. The same problem is encountered at the valve stems. Therefore, after a first period in which concrete advantages were encountered in terms, for example, of increased available power and decreased consumption, the oxidation and decreased lubrification of the above mentioned parts of the engine cancel any advantages and lead to damage to the engines.

Various attempts have been made to prevent the problem of oxidation by adding to the fuel not only low molecular weight alcohols but also vegetable oils such as corn oil, coconut oil, soy oil, etc. as well as animals oils. These attempts however could not be extended to the case in which water was added to the fuel as well, with or without alcohols, since the oils are not soluble in water.

There was a limit to the increased yield to be obtained by adding water to the fuel.

Finally, because of the cost of these oils, such additives were never widely used.

Among the attempts made to prevent engine oxidation with fuels treated with one or more alcohols, U.S. Pat. No. 2,117,610 even proposes replacing the gasoline with a mixture of, among others, butyl alcohol (35%), ethyl alcohol (20%) and corn oil (5%), or other vegetable oils. U.S. Pat. No. 2,345,579 describes a fuel stabilizer which is an antioxidant, prepared from vegetable oil and lower mono-hydroxyl alcohols with 3 to 6 carbon atoms. Many vegetable oils are indicated as suitable for use. U.S. Pat. No. 2,807,527 indicates resins of vegetable oils to be used in gasoline in order to prevent corrosion and rust, which may be diluted with a suitable alcohol solvent. U.S. Pat. No. 4,300,912 describes a fuel for automobiles which may contain butanol (20 to 40%), methanol (10 to 40%), 0.0001 of colloid stabilizer and 20 to 60% heavy hydrocarbon. The latter may be diesel fuel, oil made from coal and vegetable oil. U.S. Pat. No. 4,359,324 describes a diesel fuel mixture which may include a vegetable oil and a butyl alcohol like isobutyl alcohol.

Many other documents describe the use of vegetable oils in fuel mixtures for many uses. For example, U.S. Pat. No. 663,370 describes the use of coconut oil in gasoline. U.S. Pat. No. 2,214,749 describes the use of vegetable oils for antiknock purposes. U.S. Pat. No. 3,849,323 describes fuel additives which may include a variety of natural oils.

None of the documents cited provides for the addition of water to the fuel.

However, U.S. Pat. Nos. 1,587,899 and 3,818,876 describe the use of fuels containing water, but do not involve the addition of oils.

None of the documents cited involves the use of substances extracted from prickly pear leaves.

The present invention proposes eliminating the problem of oxidation in Otto cycle engines in which the fuel (gasoline, LP or methane) is treated with water and/or alcohols, suggesting a low cost additive for the fuel (gasoline, LP or methane) to be used in Otto cycle engines, which additive also makes the engine parts extremely slippery, contributing decidedly to reducing fuel consumption, to increasing the power delivered by the engine as well as to eliminating the use of polluting additives like tetraethyl lead, and leading to immediate ignition of the engine when cold, to pronounced improvement in performance, to engine regularity at low engine speed, and to increased silence.

The invention achieves this goal by realizing a fuel additive consisting of a mixture of water, low molecular weight alcohols and a liquid pressed from prickly pear leaves.

The present invention was inspired by the observation that a sheet of carbon steel at high temperature, on which liquid pressed from prickly pear leaves (opuntia ficus indica) had accidentally fallen, even after several weeks of exposure to the atmosphere showed no oxidation at all and remained 'slippery' to the touch in the exposed area. However the sheet had a considerable layer of residue. Repeated tests rubbing with a cloth impregnated with various substances like gasoline, diesel fuel and alcohol could not remove said residues. However, rubbing with a water soaked cloth removed every trace of residue. These attempts were continued until no residue remained on the sheet. No fingerprints were left on touching the sheet. Even though the surface was free of oil, it surprisingly remained extremely slippery, like a ferrous metal ready to be chrome plated. And furthermore, this slipperiness remained even after 2 to 3 months. Therefore, it could be deduced that the presence of water in the liquid extracted from the prickly pear leaves even in very small percentages, endowed the latter with optimal properties of shine and slipperiness. The presence of residues on the surface of the sheet could be attributed to impurities present in the extracting liquid.

Therefore this liquid was carefully prepared by removing first of all the perimeter of the leaves, and then cutting them in small pieces and crushing them in a whirlpool, before adding distilled water equal in weight to the solid material. The resulting liquid was extremely colloidal in consistency, and was decanted and filtered to remove approximately 20–30% of the impurities and mucilage. This liquid was placed on an identical carbon steel sheet and heated to the temperature used in the first experiment. There was no trace of residue and an exceptional slipperiness was observed.

At this point, it was decided to determine whether the observed phenomena could be put to a practical application by preventing oxidation in Otto cycle engines in which water and/or alcohols were added to the fuel.

Therefore an experiment was run comparing two sheets of carbon steel. Both were carefully polished with sand paper until they were equally bright and shiny. One was treated with normal motor oil; the other with liquid pressed from prickly pear leaves prepared as descrubed above. Both sheets were heated to a temperature near that occurring in an Otto cycle engine, and both the products spread on the sheets were observed to dry completely. The sheet treated with normal motor oil showed signs of oxidation after 10 to 15 days, and the oxidation increased after a few months. The sheet was dry to the touch, and so not slippery. The sheet treated with the liquid extracted from the prickly pear leaves was on the other hand completely free of oxidation and remained so even after the period of a few months, maintaining its surface bright and slippery to the touch, as if it were lubricated.

This encouraging result suggested that the liquid pressed from the prickly pear leaves, obtained as illustrated above, be placed in an Otto cycle engine of an automobile. However, the liquid was too oily, very dense and non viscous, and so therefore required further dilution with distilled water: 8 ml of liquid for 992 ml of distilled water.

This liquid was mixed with fuel by placing it in the engine's carburetor so to as obtain an intimate mixture, in the pulverized state, of the liquid with the fuel. The quantity to be placed in the fuel was measured by means of a calibrated nozzle, taking into account the specific type of engine. The inlet was controlled by the same accelerator controlling fuel inlet (see Italian patent application Nos. 49 559 A/80 and 49 246 A/81, as well as German patent application No. 3036834.4-13.

After a lengthy test period, all the parts of the engine (pistons, fan belts, valve stems, etc.) were found to be completely smooth, slippery and bright, in addition to being completely free of any trace of oxidation. Laboratory tests revealed that these parts were covered with a passive protective film which was too thin to be analyzed using even the most advanced methods (electron microscope, X-ray microscope, etc.).

Performing a laboratory analysis of the liquid pressed from the prickly pear leaves, in order to determine its composition in the state in which it shows its antioxidant and lubricating properties, required removing its impurities by decanting and filtration. This operation would have been impossible due to the very nature of the extract, unless the solid material were diluted in equal measure with distilled water. Therefore, the liquid pressed from the prickly pear leaves was analyzed in this state, giving the following results:

96.68%: water
1.47%: reducing sugars, as follows
fructose: 43.3%
$\alpha$ and $\beta$ glucose: 54.8%
sorbitol: 1.9%
0.19%: protein substances not further identified
0.16%: lipids, as follows:
$C_{12}$: 2.7% lauric acid
$C_{14}$: 1.3% myristic acid
$C_{16}$: 18.7% palmitic acid
$C_{18}$: 0.9% stearic acid
$C_{18}$: 66.8% linoleic acid with two double bonds;

the remainder consisting of minor constituents not further identified; in addition to be above substances, the mixture contained 0.18% mucilage as residues of galactose, arabinose, diramnose and hylose, and 0.18% of pectide substances.

Which of these substances is or are responsible for the antioxidant and lubricating properties of the liquid is not known. One last consideration must be added: repeated tests on the same metals of which the essential moving parts of the engine were made, were run with the above liquid at various temperatures. The antioxidant and lubricating effect of the fundamental characteristics in terms of the aim of the invention:

antioxidant
lubricating
water soluble.

The quantity of water contained in the liquid, that added equal to the weight and that added later in proportions of 992 ml to 8 ml of liquid, reduced the inflammability of the fuel. In particular, on rainy days the engine gave poor performance due to excess humidity. Furthermore, said quantities of water slightly reduced the carbon content of the fuel.

In order to return to equilibrium, it was decided to add methyl alcohol in order to restore the inflammability, and butyl alcohol to compensate for the reduced carbon level due to the water, since it is rich in carbon. However, these two alcohols were not miscible with the extract and the water. It was observed however that ethyl alcohol promoted and facilitated the desired mixing. Therefore, the liquid pressed from the prickly pear leaves obtained by crushing of the latter after adding an equal weight of distilled water, decanting and filtration, was treated with the necessary amounts to prepare additives for Otto cycle engines to be mixed with the fuel used. Specifically, for gasoline engines:
pressed liquid, as above: 8–10 ml
water: 700–850 ml
ethyl alcohol: 80–30 ml
methyl alcohol: 120–70 ml
butyl alcohol: 80–30 ml
for LP or methane operated vehicles:
pressed liquid, as above: 10–15 ml
water: 700–800 ml
ethyl alcohol: 60–40 ml
methyl alcohol: 120–100 ml
butyl alcohol: 80–40 ml.

For cars with small displacement engines, consumption of this additive varies from 3 to 4 ml/km; for large displacement engines, it does not reach 8 ml/km.

It was observed that the engine of a vehicle which had been completely redone and in which the additive according to the invention had been added just after the work was done, after running approximately 2000 km no longer had the necessary adjustment between the cylinder cams, the pistons and the fan belts. This suggests that, before the additive is used, the engine should have gone through a certain break in period.

The average fuel savings observed for automobiles of small, medium and large displacement was between 15 and 18% for gasoline powered vehicles and between 10 and 12% for LP or methane powered ones. It should be noted that using the additive according to the invention eliminates the need for occasional gasoline lubrication and, therefore, the carburetor may be replaced by a mixer.

In addition to the complete absence of oxidation and the reduced consumption, the following results were noted: immediate ignition of the engine when cold and particularly improved response (especially in LP and methane vehicles) to the point where, in some cases of high compression ratio gasoline engines, the maximum could be reduced, or rather the outlet of the acceleration pump; increase in available power; regularity of the engine at low engine speeds; increased silence; decided reduction in the pollution due to the exhaust gas from the presence of the alcohols, thanks to which no tetraethyl lead need be added.

Finally it should be noted that in some countries many vehicles are powered by alcohol only, or by alcohol hydrate, while in others distributors are already provided, or will be provided, with a fuel already containing in part alcohol hydrate. Under these circumstances, the oxidizing action of the alcohol and water will be even more evident, even to the maximum degree, with consequent problems related to the yield of the engines and their damage.

Therefore, as needed, sufficient preparation of liquid pressed from prickly pear leaves should be established to be used as a fuel additive, in order to prevent oxidation and so preserve the engine, while achieving the advantages listed above.

I claim:

1. Fuel additive for Otto cycle engines consisting essentially of a mixture of water, low molecular weight alcohols and liquid extracted from prickly pear leaves, said liquid being present in an amount and in concentrations sufficient to provide a passive protective film on the parts of said engine whereby said parts are smooth, slippery and bright and free of oxidation.

2. Additive as claimed in claim 1, wherein the liquid extracted from prickly pear leaves is obtained by removing the perimeter of the leaves, cutting said leaves into small pieces, crushing the cut leaves, adding distilled water substantially equal in weight to the solid material, and then decanting and filtering the liquid obtained.

3. Additive as claimed in claim 1, wherein said low molecular weight alcohols are ethanol, methanol and butanol.

4. Fuel additive as claimed in claim 1 for gasoline wherein it includes:

extracted liquid: 8–10 ml
water: 700–850 ml
ethyl alcohol: 80–30 ml
methyl alcohol: 120–70 ml
butyl alcohol: 80–30 ml.

5. Fuel additive as claimed in claim 1 for LP or methane wherein it includes:

extracted liquid: 10–15 ml
water: 700–800 ml
ethyl alcohol: 60–40 ml
methyl alcohol: 120–100 ml
butyl alcohol: 80–40 ml.

6. Fuel additive as claimed in claim 3, wherein said extracted liquid consists essentially of 96.68% water, with the remainder consisting essentially of 1.47% reducing sugars, 0.19% protein substances, 0.16% lipids, 0.18% mucilage and 0.18% pectide substances.

7. Additive as claimed in claim 6, wherein said reducing sugars include 43.3% fructose, 54.8% $\alpha$ and $\beta$ glucose and 1.9% sorbitol.

8. Additive as claimed in claim 6, wherein said lipids include 2.7% N-lauric acid; 1.3% myristic acid; 18.7% N-palmitic acid, 0.9% N-stearic acid; 66.8% N-linoleic acid with two double bonds.

9. Fuel mixture for an automobile obtained by combining gasoline, LP or methane with the additive as claimed in claim 3.

10. Fuel mixture as claimed in claim 9, wherein the additive is mixed with the fuel by injection into the carburetor of said automobile by means of a pulverizing nozzle, the outlet of said pulverizing nozzle being the type specific for the engine and the input being controlled by the same control as that for fuel input.

11. Fuel mixture as claimed in claim 9, wherein the liquid extracted from prickly pear leaves is present in an amount sufficient to prevent oxidation in the engine of said automobile associated with the addition to fuel of water, alcohol or mixtures thereof.

12. The method of preventing oxidation in the engine of an automobile, said oxidation associated with the addition to gasoline for use in said engine of water, alcohol and mixtures thereof, which method comprises adding to said gasoline the fuel additive as claimed in claim 4.

13. The method as claimed in claim 12 for use in an automobile with a small displacement engine wherein the additive is consumed in said engine in an amount from three to four ml/km.

14. The method as claimed in claim 12 for use in an automobile with a large displacement engine wherein the additive is consumed in said engine in an amount up to eight ml/km.

15. The method of preventing oxidation in the engine of an automobile, said oxidation associated with the addition to LP or methane for use in said engine of water, alcohol or mixtures thereof, which method comprises adding to said LP or methane the fuel additive as claimed in claim 5.

16. The method as claimed in claim 15 for use in an automobile with a small displacement engine wherein the additive is consumed in said engine in an amount from three to four ml/km.

17. The method as claimed in claim 15 for use in an automobile with a large displacement engine wherein the additive is consumed in said engine in an amount up to eight ml/km.

18. Fuel additive for an Otto cycle engine comprising a liquid extracted from prickly pear leaves added to the fuel in an amount sufficient to provide a passive protective film on the parts of said engine whereby said parts are smooth, slippery and bright and free of oxidation.

19. Fuel additive as claimed in claim 18 wherein said liquid is obtained by crushing the prickly pear leaves and adding distilled water thereto substantially equal in weight to the solid material.

* * * * *